US005968303A

United States Patent [19]

Nagasaka

[11] Patent Number: 5,968,303

[45] Date of Patent: Oct. 19, 1999

[54] METHOD AND APPARATUS FOR STICKING A LABEL

[75] Inventor: Toshihide Nagasaka, Kanagawa, Japan

[73] Assignee: Fuji Photo Film Co., Ltd., Kanagawa, Japan

[21] Appl. No.: 09/057,510

[22] Filed: Apr. 9, 1998

[30] Foreign Application Priority Data

Apr. 10, 1997 [JP] Japan ..... 9-091937

[51] Int. Cl.[6] ..... B65C 1/00; B65C 9/06; B65C 9/26

[52] U.S. Cl. ..... 156/249; 156/362; 156/542; 156/556; 156/DIG. 1; 156/DIG. 27; 156/DIG. 37

[58] Field of Search ..... 156/542, 556, 156/360, 361, 362, 249, DIG. 1, DIG. 27, DIG. 37

[56] References Cited

U.S. PATENT DOCUMENTS 4,336,095 6/1982 Hoffmann ..... 156/361

5,587,043 12/1996 Hying et al. ..... 156/566

*Primary Examiner*—Curtis Mayes

*Attorney, Agent, or Firm*—Sughrue, Mion, Zinn, Macpeak & Seas, PLLC

[57] ABSTRACT

A label is supplied from a label supplier to a rotating suction drum. The supplied label is absorbed on the suction drum and conveyed to a label sticking station. During conveyance of the label, passage time of the label at a predetermined point is measured, and a first shifting amount of the label relative to a label conveying direction is calculated. A standby position of the work in the label conveying direction is altered based on the first shifting amount. Further, during conveyance of the label, its location relative to a perpendicular direction to the label conveying direction is detected, and a second shifting amount of the label relative to the perpendicular direction is calculated. A standby position of the work in the perpendicular direction is altered based on the second shifting amount. The position of the work is adjusted to the label so that the label is stuck on the work with great accuracy.

38 Claims, 9 Drawing Sheets

METHOD AND APPARATUS FOR STICKING A LABEL

BACKGROUND OF THE INVENTION

1. Field of the Invention

The present invention relates to a label sticking method and a label sticking apparatus for sticking a label on a workpiece with great accuracy.

2. Description of the Related Art

In order to enjoy ease of photography when a camera is not carried, a lens-fitted film unit (its trade name is "Quick Snap Hi" and so forth) is provided by an assignee of the present application. As to the lens-fitted film unit, a unit body in which an unexposed photographic film and an exposure mechanism are beforehand built in is covered with a box-like case, for example, a paper case.

This box-like case has a complicated shape so that its material cost, its punching cost and so forth are expensive. Further, such a box-like case has shortcomings that an attachment process to the unit body is complex, and that it is troublesome to detach it at the time of recycling. In view of the foregoing, the assignee of the present application suggests an invention that an outer peripheral surface of the unit body is wrapped with a strip-like label instead of the box-like case. This invention is disclosed in U.S. patent application Ser. No. 08/683,758 filed on Jul. 17, 1996 (corresponding to Japanese Patent Laid-Open Publication No. 9-33996).

By the way, on a front face of the unit body, a protrusion for protecting a taking lens and a shutter mechanism is formed. On the other hand, an opening through which the protrusion projects is formed in the above-mentioned label. It is necessary to accurately adjust positions regarding the protrusion of the unit body and the opening of the label. However, there are variations in label punching positions of a label tape. Accordingly, when a label sticking operation is performed by using, for example, a robot hand provided with an absorption head, the position of the label absorbed on an absorption face of the absorption head is not fixed. Therefore, there arises a problem in that it is difficult to stick the label accurately. If the position of each label is accurately measured every absorption of the label and the robot hand is precisely controlled, it is possible to stick the label with great accuracy. However, in this case, there arises a problem in that it is difficult to perform the label sticking operation at high speed.

SUMMARY OF THE INVENTION

In view of the foregoing, it is a primary object of the present invention to provide a method and an apparatus for sticking a label in which the label is stuck on a workpiece with great accuracy.

It is a second object of the present invention to provide a method and an apparatus for sticking a label in which label sticking is performed at high speed.

It is a third object of the present invention to provide an apparatus for sticking a label having a simple structure to lower the cost of manufacture equipment.

In order to achieve the above and other objects, the method and the apparatus for sticking the label according to the present invention comprises a sensor for detecting the label while the label is conveyed to a label sticking station where label sticking is performed.

In a preferred embodiment, during the conveyance of the label, a first sensor measures the passage time of the label at a predetermined point, and a second sensor detects a location of the label relative to a width direction of the suction drum. Based on information obtained by these sensors, a standby position of a workpiece on which the label is stuck is altered.

The label is adapted to be supplied from a label supplier to a suction drum rotating in a label forwarding direction, hereinafter X direction. The supplied label is absorbed on a peripheral surface of the suction drum and conveyed to the label sticking station according to the rotation thereof.

On the other hand, a film unit as the workpiece is conveyed by a conveyor belt toward the suction drum. When the film unit is detected by a photo sensor, the film unit is carried from the conveyor belt to a tray for feeding the label to the label sticking station. By the way, in this embodiment, the label is arranged on a release paper which is advanced on the label supplier. By advancing the release paper, the label is separated therefrom at a tip of the label supplier and thrust toward the suction drum. The thrust label is absorbed on the suction drum and conveyed to the label sticking station.

During conveyance of the label, the first sensor detects a front edge of the label, and based on this detection, a first shifting amount is calculated. The first shifting amount is a distance between the actual label position and a label reference position relative to the X direction. The tray on which the film unit is placed is moved in the X direction to alter the standby position of the film unit, based on the first shifting amount.

Further, during conveyance of the label, the second sensor detects a side edge of the label, and a second shifting amount is calculated. The second shifting amount is a distance between the actual label position and a label reference position in a perpendicular direction to the X direction, hereinafter Y direction. The tray is moved in the Y direction to alter the standby position of the unit body, based on the second shifting amount.

When the label approaches the label sticking station, the film unit is fed thereto in a state that its position is adjusted to the label so that the label is stuck on the film unit with great accuracy.

BRIEF DESCRIPTION OF THE DRAWINGS

The above objects and advantages of the present invention will become apparent from the following detailed description of the preferred embodiments of the invention when read in conjunction with the accompanying figures, in which.

DETAILED DESCRIPTION OF THE PREFERRED EMBODIMENT(S)

Figure 1:
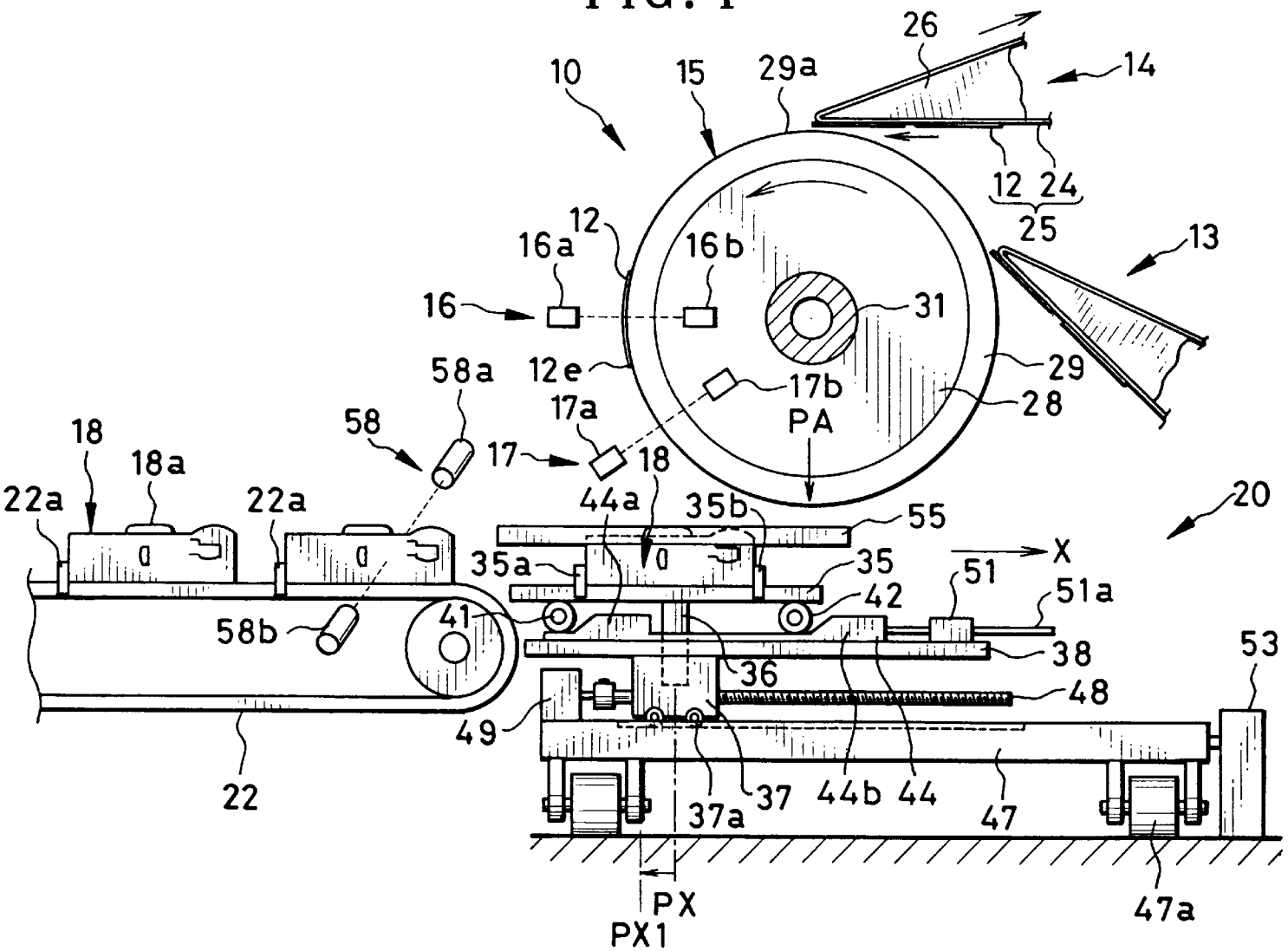
FIG. 1 is an explanatory side view of a label sticking apparatus according to the present invention.

In FIGS. 1 through 4, a label sticking apparatus 10 comprises a label supplier 14, a suction drum 15 and a work moving device 20. The label supplier 14 forwards a label 12 one by one. The suction drum 15 absorbs the label 12 on a peripheral surface thereof and rotates. The work moving device 20 feeds a workpiece to a label sticking station PA. In this embodiment, a lens-fitted film unit (hereinafter, film unit) 18 is used as the workpiece. The label 12 is wound on a periphery of the film unit 18 in a ring-like state.

As a material of the label 12, it is possible to use polyethylene terephthalate (PET), synthetic paper polystyrene (PS) and polypropylene (PP), for example. The label 12 has a strip-like shape. Print is performed on an upper face of the label 12, and adhesive is applied to a lower face thereof. The lower face of the label 12 contacts a film-like release paper 24. The labels 12 are arranged on the release paper at a predetermined pitch, and constitute a label tape 25.

Figure 4:
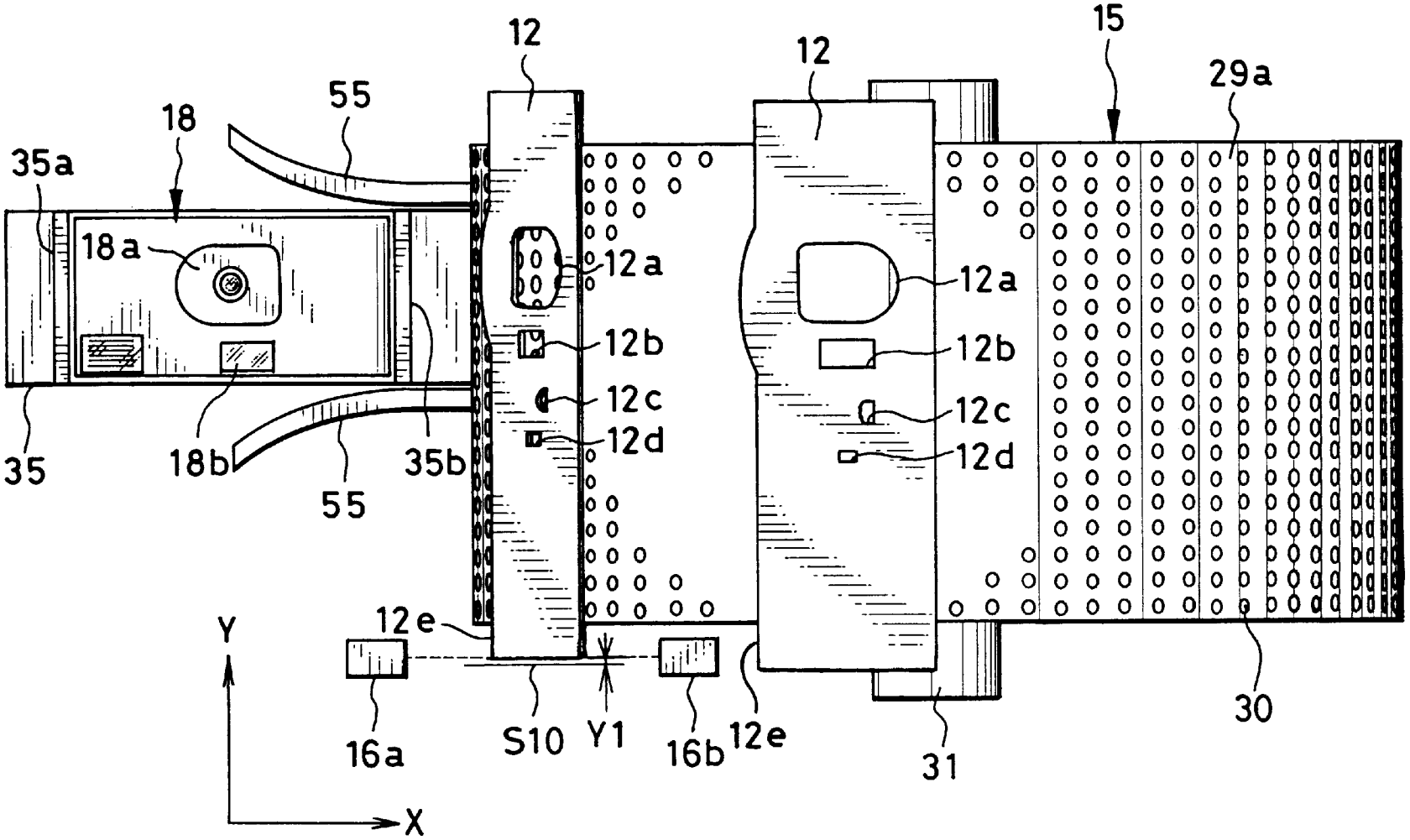
FIG. 4 is an explanatory plan view of the label sticking apparatus.

The label 12 is formed with openings 12*a*, 12*b*, 12*c* and 12*d* as shown in FIG. 4. Into the opening 12*a*, a lens portion 18*a* protruding on the film unit 18 is fitted. The openings 12*b* and 12*d* overlap on a viewfinder 18*b* of the film unit 18. The opening 12*c* overlaps on a film counter window (not shown) indicating a number of unexposed frames. In this embodiment, a direction in which the label 12 and the film unit 18 move to the label sticking station PA is denoted by a reference letter X, and a direction being perpendicular to the X direction is denoted by a reference letter Y.

As to the label supplier 14, a tip 26 thereof has a V-like shape. A lower face of the tip 26 is substantially horizontal and directed in a tangential direction to said suction drum 15. When the label tape 25 moves along the tip 26 in a direction shown by arrows in FIG. 1, the release paper 24 moves, turning along the tip 26. However, the label 12 goes straight that the label 12 is torn off from the release paper 24 and placed on the suction drum 15 in a state that its lower face on which the adhesive is applied faces upward.

At an upstream side of the label supplier 14 relative to the suction drum 15, a spare label supplier 13 is disposed. When another label is supplied to the suction drum 15 by the spare label supplier 13, it is possible to stick plural kinds of the labels selectively with only one label sticking apparatus.

The suction drum 15 is rotatably provided around a hollow shaft 31 so as to be rotated by a motor 60 (refer to FIG. 5) in an arrow direction in FIG. 1. The suction drum 15 is constituted of a drum body 28 and an elastic ring 29 attached to a periphery of the drum body 28. The drum body 28 has a cylindrical shape, and both ends thereof are closed. The hollow shaft 31 is fixed to the both ends so as to pass through the inside of the drum body 28.

The drum body 28 is provided with a plurality of holes formed on the peripheral surface thereof. Further, the elastic ring 29 is also formed with small holes 30 for absorbing the label 12. The elastic ring 29 is made of sponge, rubber or the like so that the lens portion 18*a* of the film unit 18 is capable of entering the opening 12*a* of the label 12 at the label sticking station PA. Since the hollow shaft 31 is connected to a suction blower (not shown), the label 12 is absorbed and retained on a peripheral surface 29*a* of the elastic ring 29 by means of the absorbing holes 30 of the elastic ring 29.

At the label sticking station PA, absorption by the absorbing holes 30 is stopped so that the label 12 is adapted to be securely stuck on the film unit 18. By the way, when the absorbing force of the suction drum 15 is weak in comparison with an adhesion force due to the adhesive of the label 12, the absorption by the absorbing holes 30 may not be stopped at the label sticking station PA.

A conveyor belt 22 is intermittently rotated, in a state that the film unit 18 is placed thereon, at a pitch corresponding to an interval between projections 22*a* for partitioning the film unit 18. The projection 22*a* is for regulating a position of the film unit 18 on the conveyor belt 22. At a right end of the conveyor belt 22 in FIG. 1, a photo sensor 58 comprising a light emitter 58*a* and a light receiver 58*b* is disposed. When the film unit 18 is detected by the photo sensor 58, the film unit 18 is carried from the conveyor belt 22 to the work moving device 20 by means of a robot hand (not shown).

The work moving device 20 is provided with a tray 35 for holding the film unit 18 and moving it in the X direction. On a lower portion of the tray 35, a post 36 is fixed. This post 36 is attached to a support member 37 so as to be movable in a vertical direction. Moreover, on the lower portion of the tray 35, rollers 41 and 42 are provided. A pair of guides 55 are provided at both sides of the tray 35. The guides 55 guide both sides of the film unit 18 to regulate its position relative to the Y direction. Further, the tray 35 is provided with a pair of dampers 35*a* and 35*b* for holding both ends of the film unit 18.

A horizontal table 38 is fixed to the support member 37. On the table 38, a cam plate 44 slid by a cylinder 51 in the X direction is provided. The cam plate 44 has trapezoid portions 44*a* and 44*b*. These trapezoid portions 44*a* and 44*b* enter under the rollers 41 and 42 respectively so that the tray 35 is raised. In this embodiment, two rollers 41 and 42 are used, however, the rollers may be used two by two in the Y directions. At this time, four rollers are used in total, accordingly, the trapezoid portions are also provided by four.

At a lower end of the support member 37, four rollers 37*a* are provided. The support member 37 is placed on the truck 47 via the rollers 37*a*. When a motor 49 attached to the truck 47 is driven, the support member 37 is moved, via a feed screw 48, in the X direction together with the tray 35. The truck 47 is provided with four rollers 47*a* at a lower portion thereof, and moved in the Y direction by means of a drive unit 53.

Laser sensors 16 and 17 are disposed around the suction drum 15. The laser sensor 16 detects passage of a front edge 12*e* of the label 12. The laser sensor 17 detects a side edge position of the label 12. The laser sensor 16 comprises a beam emitter 16*a* for emitting a laser beam, and a beam receiver 16*b* for detecting the laser beam. Similarly, the laser sensor 17 comprises a beam emitter 17*a* and a beam receiver 17*b*.

In order to perform label sticking in a predetermined cycle, the label supplier 14 forwards the label 12 in synchronism with the rotation of the suction drum 15. Further, the work moving device 20 is adapted to move the tray 35 from a standby position to the label sticking station PA in synchronism with the rotation of the suction drum 15.

Figure 5:
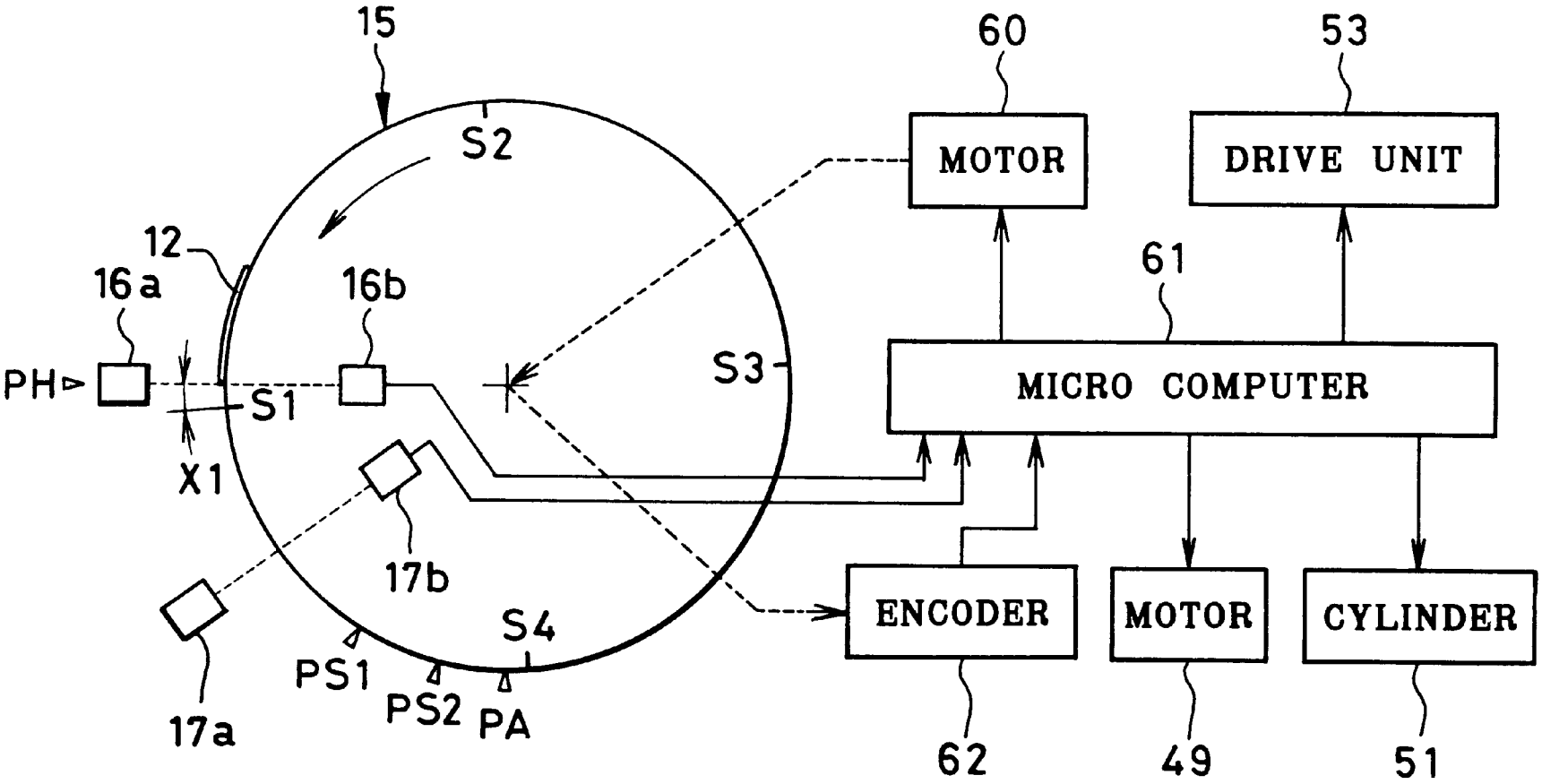
FIG. 5 is a schematic illustration showing a structure for detecting a label.

As shown in FIG. 5, label reference positions S1, S2, S3 and S4 are determined on the suction drum 15 so as to be positioned at an interval of 90 degrees in the X direction. Each of the labels 12 is supplied from the label supplier 14 to the suction drum 15 such that the front edge 12*e* of the label 12 coincides with each of the label reference positions S1 to S4. Incidentally, the number of the label reference positions is not exclusive to four. Two, three, eight and so forth are available as the number.

For example, when the label reference position S1 reaches a position PS1, the tray 35 starts to move from a reference standby position PX (refer to FIG. 1) in the X direction toward the label sticking station PA. The tray 35 moves in the X direction at a constant speed, and the film unit 18 faces the label 12 at the label sticking station PA. It is preferable that the speed of the tray 35 is the same as a peripheral speed of the suction drum 15. However, when the absorption force of the suction drum 15 is small, there is no hindrance if the speed of the tray 35 is slow.

In practice, the front edge 12*e* of each label 12 sometimes does not coincide with the label reference positions S1 to S4, and is shifted back or forth. The shifting in the X direction is caused by, for example, shifting of the label 12 on the release paper 24 and trouble at the time of transporting to the suction drum 15. When the shifting in the X direction occurs, a front edge of a stuck portion of the film unit 18 does not coincide with the front edge 12*e* of the label 12 at the label sticking station PA. In this case, for example, the lens portion 18*a* is not fitted into the opening 12*a* so that the label 12 is not accurately stuck on the film unit 18.

In order to stick the label 12 on the stuck portion of the film unit 18 accurately when the front edge 12*e* of each label 12 is shifted from the label reference positions S1 to S4, it is necessary to vary, in accordance with the shifting of the label 12 relative to the X direction, timing at which the tray 35 starts to move from the reference standby position PX. Alternatively, the standby position of the tray 35 in the X direction may be altered. In this embodiment, the tray 35 is shifted to the standby position PX1 in accordance with a shifting amount X1 of the label 12 in the X direction.

The laser sensor 16 is disposed at a position PH separating from the label sticking station PA by 90 degrees in order to detect the shifting of the label 12 relative to the X direction. The laser sensor 16 detects the front edge 12*e* of the label 12 projecting from an edge of the peripheral surface 29*a* of the suction drum 15. A detection signal from the laser sensor 16 is introduced into a micro computer 61. On the other hand, a rotary encoder 62 is provided to detect rotational positions of the label reference positions S1 to S4.

In case that time at which the label reference position S1 has passed the position PH is represented by t1, and time at which the laser sensor 16 has detected the front edge 12*e* of the label 12 is represented by t2, the time difference between these, namely t2–t1, is in proportion to the shifting amount X1 of the label 12. The shifting amount X1 is a distance between the actual label position and the label reference position S1 relative to the X direction. The micro computer 61 drives the motor 49 in accordance with this time difference, and alters the standby position of the tray 35 relative to the X direction.

The laser sensor 17 is disposed at a position separated from the label sticking station PA by 45 degrees, and measures the side edge position of the label 12 projecting from the edge of the peripheral surface 29*a*. A position signal from the laser sensor 17 is introduced into the micro computer 61. In order to fit the lens portion 18*a* into the opening 12*a* of the label 12, a label reference position S10 (refer to FIG. 4) for the side edge of the label 12 is determined relative to the Y direction. The micro computer 61 calculates a shifting amount Y1 in the Y direction based on the position signal. In accordance with the shifting amount Y1 relative to the Y direction, the drive unit 53 is operated to move the truck 47 in the Y direction. Thus, the standby position of the tray 35 in the Y direction is altered.

Figure 6:
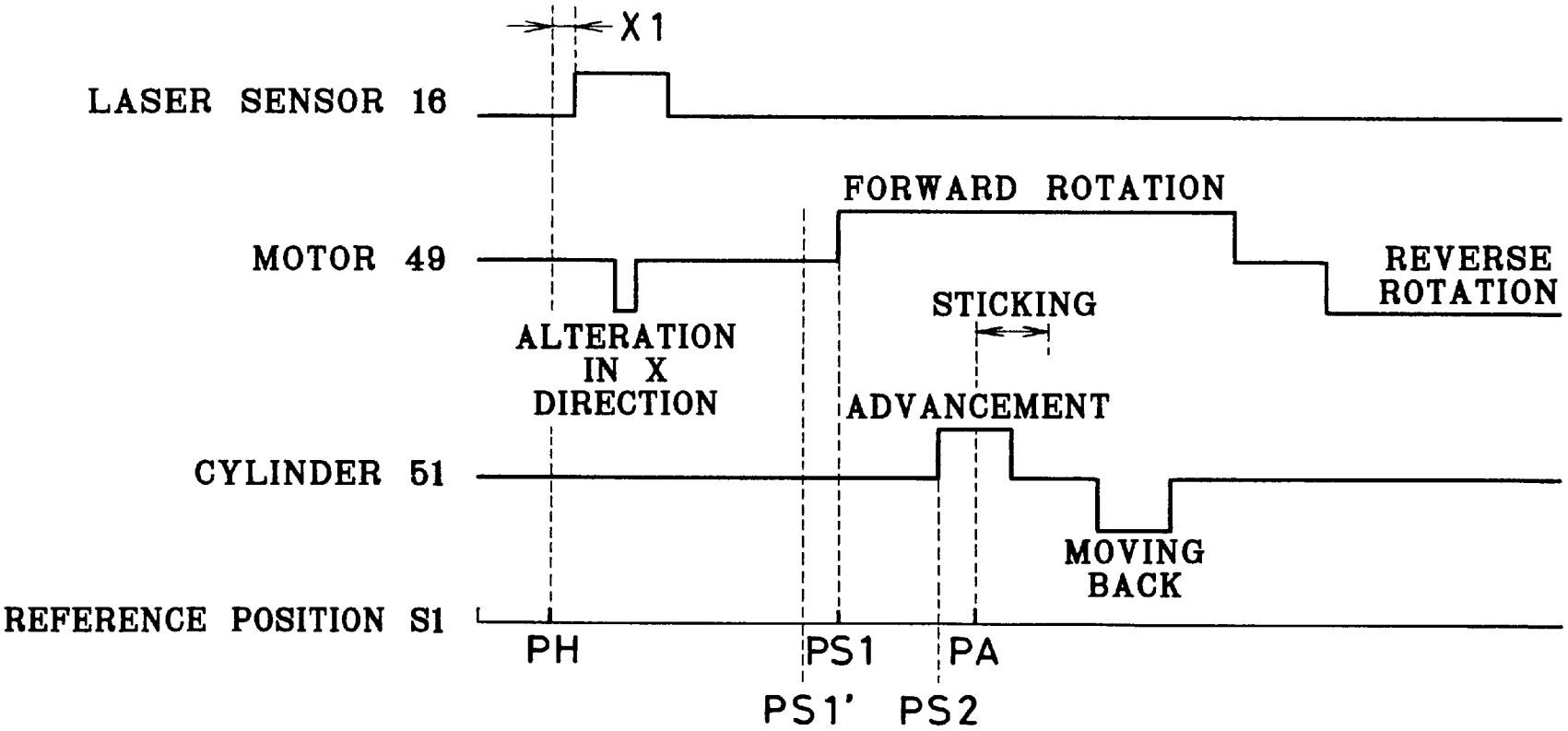
FIG. 6 is a timing chart showing signals for moving a work.

Referring to FIG. 6, an operation of the apparatus according to the present invention is described. The film unit 18 assembled on another assembly line is placed on the conveyor belt 22, and intermittently conveyed toward the work moving device 20. On the other hand, the tray 35 is set at the reference standby position PX relative to the X direction. The reference standby position PX is shown in FIG. 1.

When the film unit 18 on the conveyor belt 22 is detected by the photo sensor 58, the robot hand grasps the film unit 18 and carries it on the tray 35. After the film unit 18 has been placed on the tray 35, the dampers 35*a* and 35*b* are actuated to catch the film unit 18 from both sides thereof.

The suction drum 15 is rotated by the motor 60 at a constant speed, and its rotational position is detected by the rotary encoder 62. When the label reference position S1 comes to the position of the label supplier 14, the label tape 25 is advanced. An advancement speed of the label tape 25 is adapted to be the same as or slower than the peripheral speed of the suction drum 15.

As the label tape 25 is advanced, the label 12 is torn out of the release paper 24 from its front side. Since the suction drum 15 is absorbed with the suction blower, the label 12 is absorbed on the peripheral surface 29*a*. At this time, the label 12 is transferred to the suction drum 15 without slanting in the Y direction, keeping a posture on the release paper 24.

The label 12 is conveyed toward the label sticking station PA with the rotation of the suction drum 15 in a state that both the side edges of the label 12 project from the suction drum 15. During this conveyance, the front edge 12*e* of the label 12 passes through the laser sensor 16, and the detection signal from the laser sensor 16 is introduced into the micro computer 61. As shown in FIG. 6, the micro computer 61 calculates the shifting amount X1 of the label 12 from the label reference position S1 based on the difference between the passage time of the label reference position S1 at the position PH and the detection time of the front edge 12*e*.

After calculation of the shifting amount X1, the micro computer 61 drives the motor 49. The motor 49 rotates the feed screw 48 to move the support member 37 in the X direction. When the support member 37 is moved, the tray 35 supported thereby is moved in the X direction. Thus, the tray 35 is moved from the reference standby position PX to the altered standby position PX1. As the film unit 18 is held on the tray 35, the standby position of the tray 35 is synonymous with the standby position of the film unit 18.

Upon further rotation of the suction drum 15, the side edge position of the label 12 relative to the Y direction is measured by the laser sensor 17. The micro computer 61 finds the difference between the measured position and the reference label position relative to the Y direction. This difference represents the shifting amount Y1 of the label 12 in the Y direction. After that, the micro computer 61 actuates the drive unit 53 to move the truck 47 in the Y direction. The truck 47 is moved from the reference standby position by a same distance with the shifting amount Y1 so that the standby position of the tray 35 in the Y direction is altered.

As shown in FIG. 6, when the micro computer 61 judges, based on the signal from the rotary encoder 62, that the label reference position S1 reaches the position PS1, the motor 49 is rotated in a forward direction. The motor 49 moves the tray 35 in the X direction at a constant speed via the feed screw 48.

During movement of the tray 35 in the X direction, when the label reference position S1 reaches the position PS1, the cylinder 51 is actuated to advance a rod 51*a*. The cylinder 51 slides the cam plate 44 on the table 38 by a predetermined distance to raise the rollers 41 and 42 by means of the trapezoid portions 44*a* and 44*b*.

Figure 2:
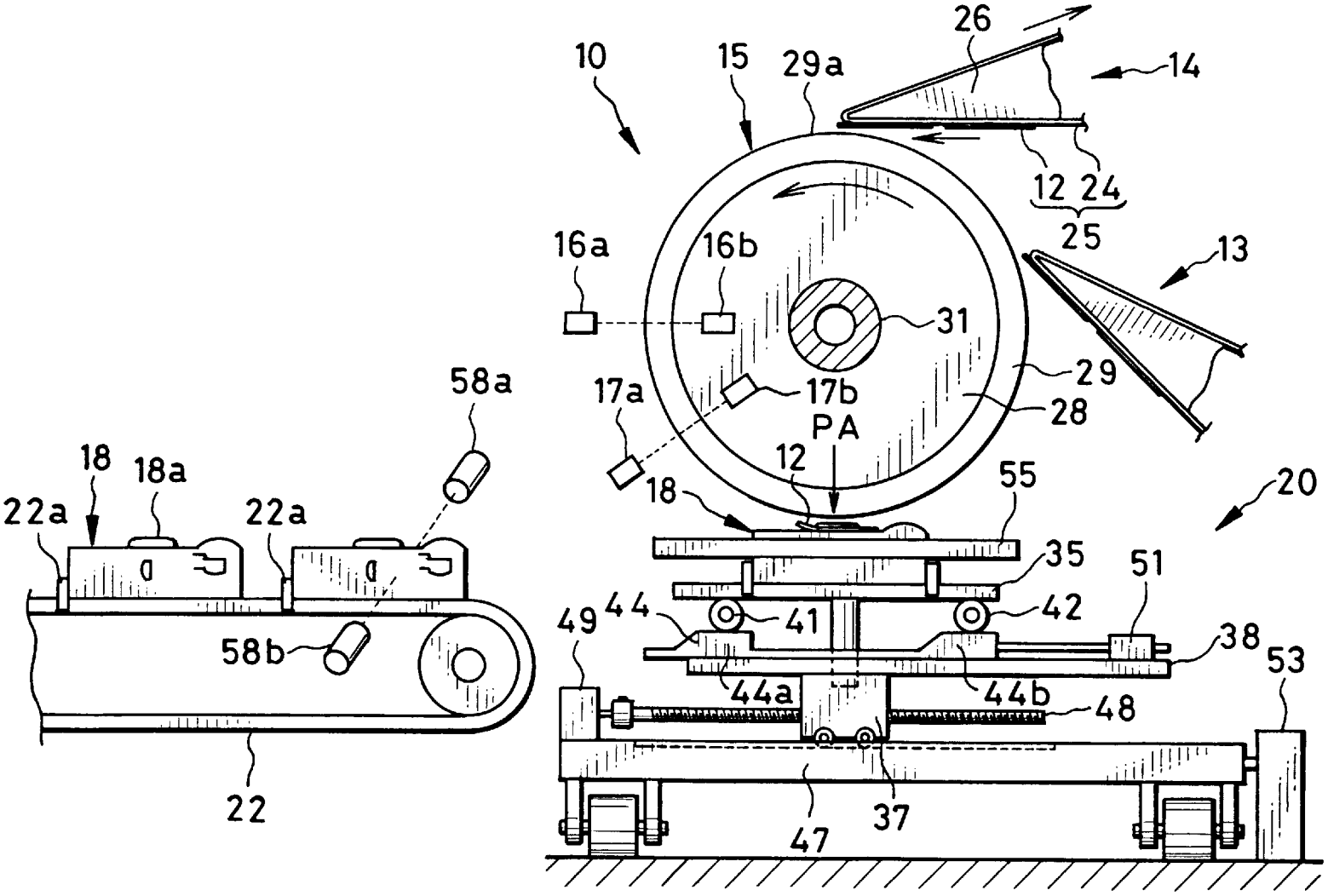
FIG. 2 is an explanatory side view of the label sticking apparatus at time of label sticking.

As shown in FIG. 2, near the label sticking station PA, the tray 35 is pushed up by the cam plate 44. Thus, the film unit 18 is raised, facing to the label 12 so that the lens portion 18 enters the elastic ring 29 by a little. The opening 12*a* of the label 12 is fitted to the lens portion 18*a*, and the label 12 is pushed to the film unit 18. The label 12 is accurately stuck to the stuck portion of the upper face of the film unit 18 by the adhesive applied to the lower face of the label 12. At this time, as to a part of the suction drum 15 having passed the label sticking station PA, the absorption is stopped so as not to disturb the sticking of the label 12.

Figure 3:
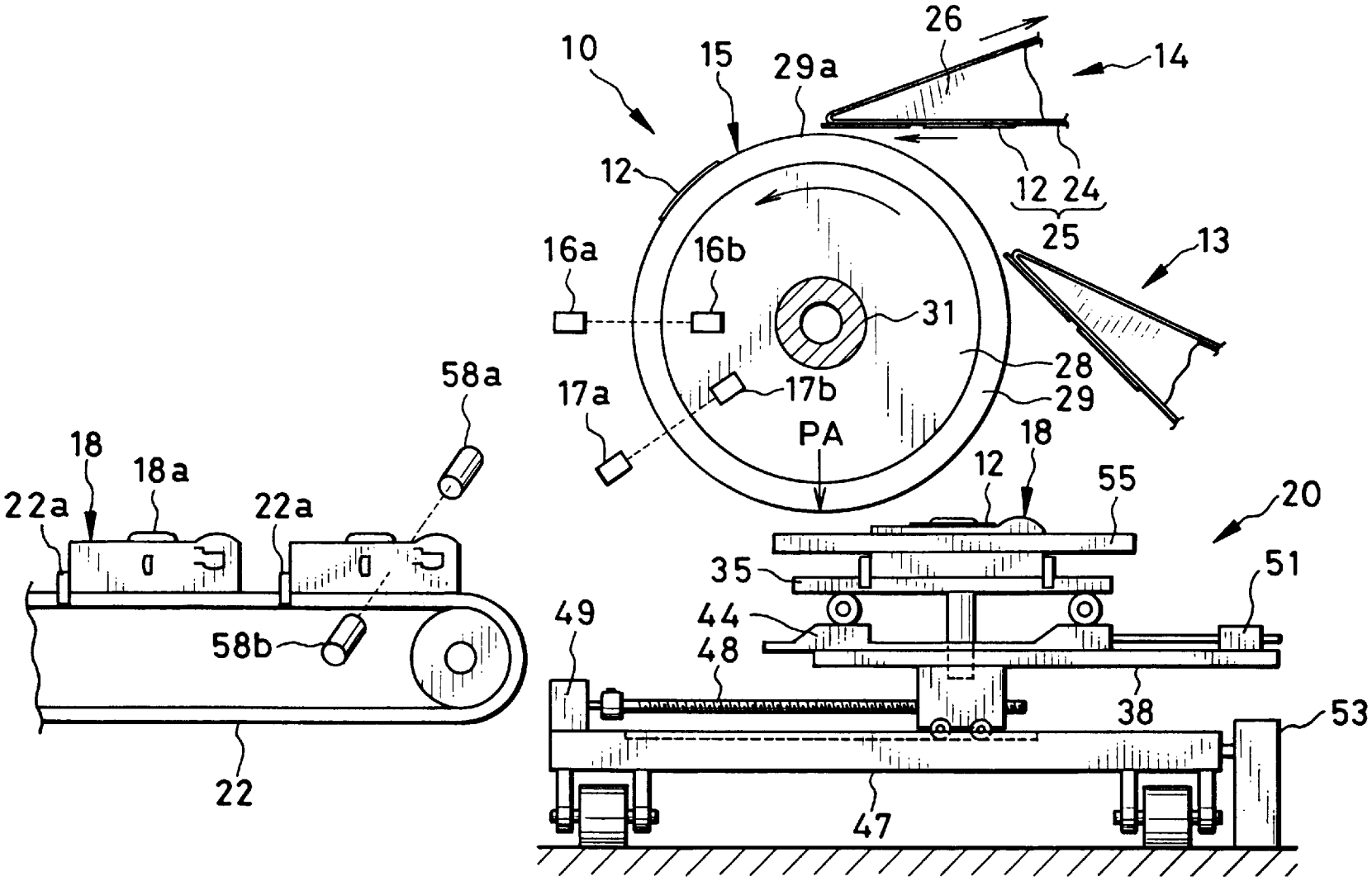
FIG. 3 is an explanatory side view of the label sticking apparatus after label sticking.

The tray 35 is successively moved in the X direction after sticking of the label 12, and passes through the label sticking station PA. During this movement, the rod 51*a* of the cylinder 51 is moved back to return the cam plate 44 to the former position so that the tray 35 is lowered. As shown in FIG. 3, after the tray 35 has passed the suction drum 15, the micro computer 61 stops the motor 49 and releases clamping by the clampers 35*a* and 35*b*.

Figure 7:
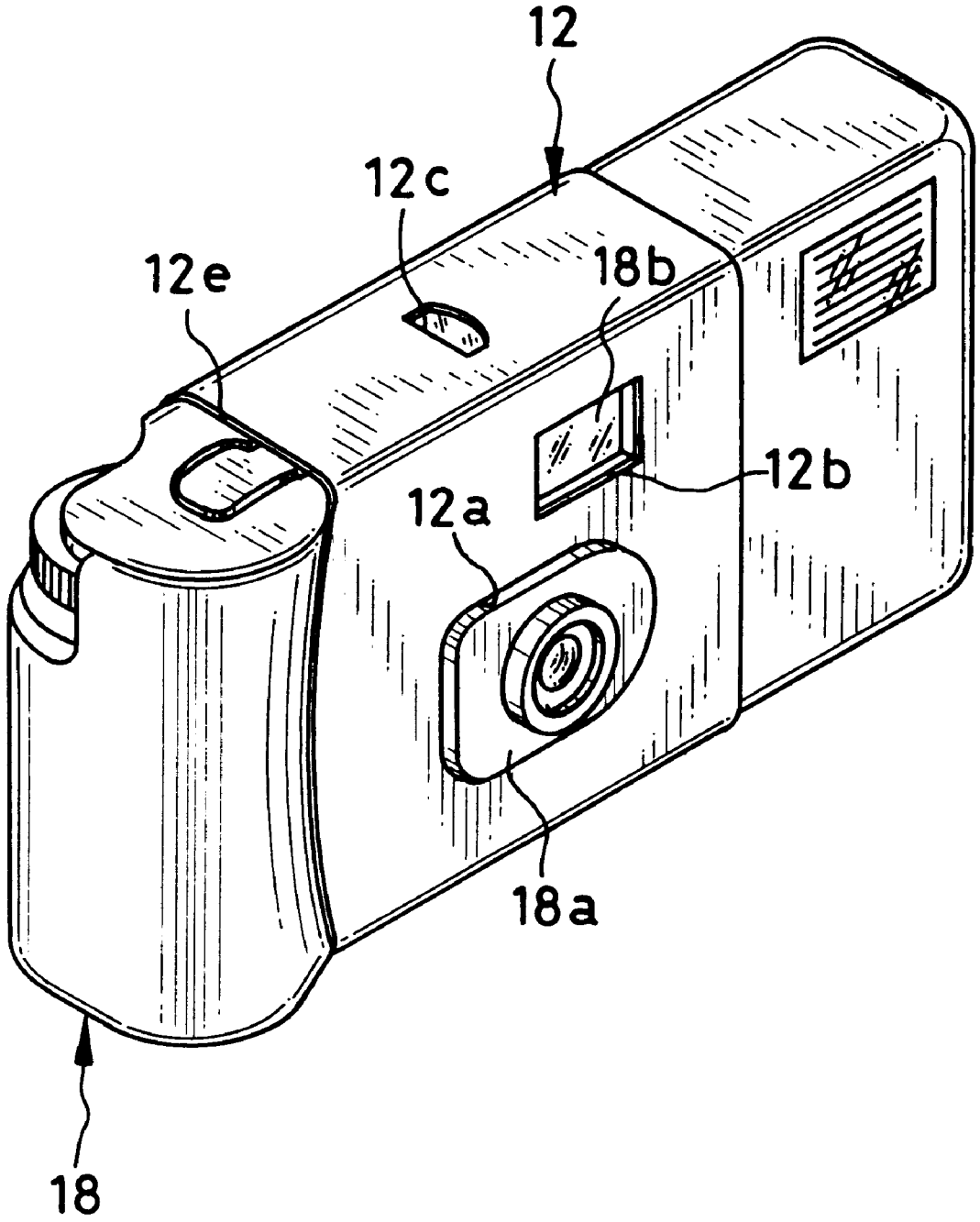
FIG. 7 is a perspective view of a lens-fitted film unit as the work.

Successively, a robot hand disposed at a right side of the suction drum 15 is actuated to take the film unit 18 out of the tray 35 and to the carry it to next process. In this process, the film unit 18 is pressed with a roller from the outside of the label 12 to stick it on a periphery of the film unit 18. Thus, as shown in FIG. 7, the label 12 is wound on a central portion of the film unit 18 in a belt-like state.

When the tray 35 becomes empty, the micro computer 61 rotates the motor 49 in a reverse direction. The tray 35 is set at the reference standby position PX relative to the X direction as shown in FIG. 1. Moreover, the micro computer 61 actuates the drive unit 53 in reverse to set the tray 35 at the reference standby position S10 relative to the Y direction.

By repeating the above-described sequence, the label 12 is stuck on the film unit 18 which is intermittently transported from the conveyor belt 22. At this time, if the label 12 is shifted from the label reference position relative to the X direction and the Y direction, the label 12 is accurately stuck on the predetermined position of the film unit 18. In this embodiment, during one rotation of the suction drum 15, the label 12 is stuck on four film units 18.

By setting the label corresponding to another film unit on the spare label supplier 13, it is possible to perform mixed production of the film unit or changing the production line. In this case, when the film unit 18 is detected by the photo sensor 58, the shape of the film unit is judged, and the label supplier on which the corresponding label is set is driven.

Figure 8:
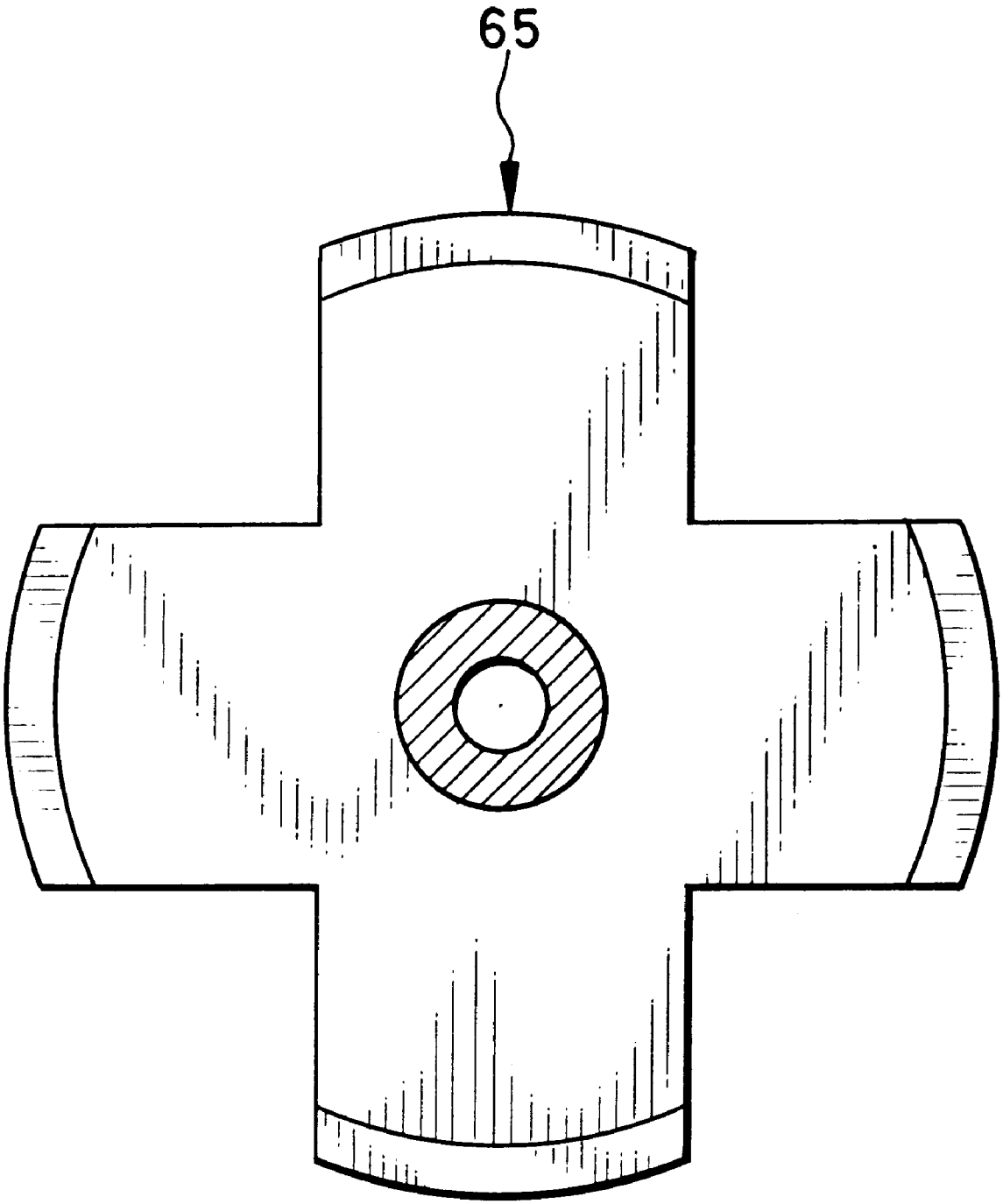
FIG. 8 is an explanatory illustration showing another embodiment of a suction drum.

The suction drum is not exclusive to the cylindrical shape shown in FIG. 1. As illustrated in FIG. 8, a suction drum 65 having a cross-like shape on its section may be employed. In this case, a number of parts for absorbing the label is limited to four. However, as the location for absorbing the label is limited, there is an advantage that the label position is more accurately detected. Further, in case the width of the part for absorbing the label is narrower than the interval between the front edge and the rear edge of the label, the front edge and the rear edge of the label project from the periphery of the suction drum. Accordingly, it becomes easy to detect the front edge or the rear edge of the label.

Figure 9:
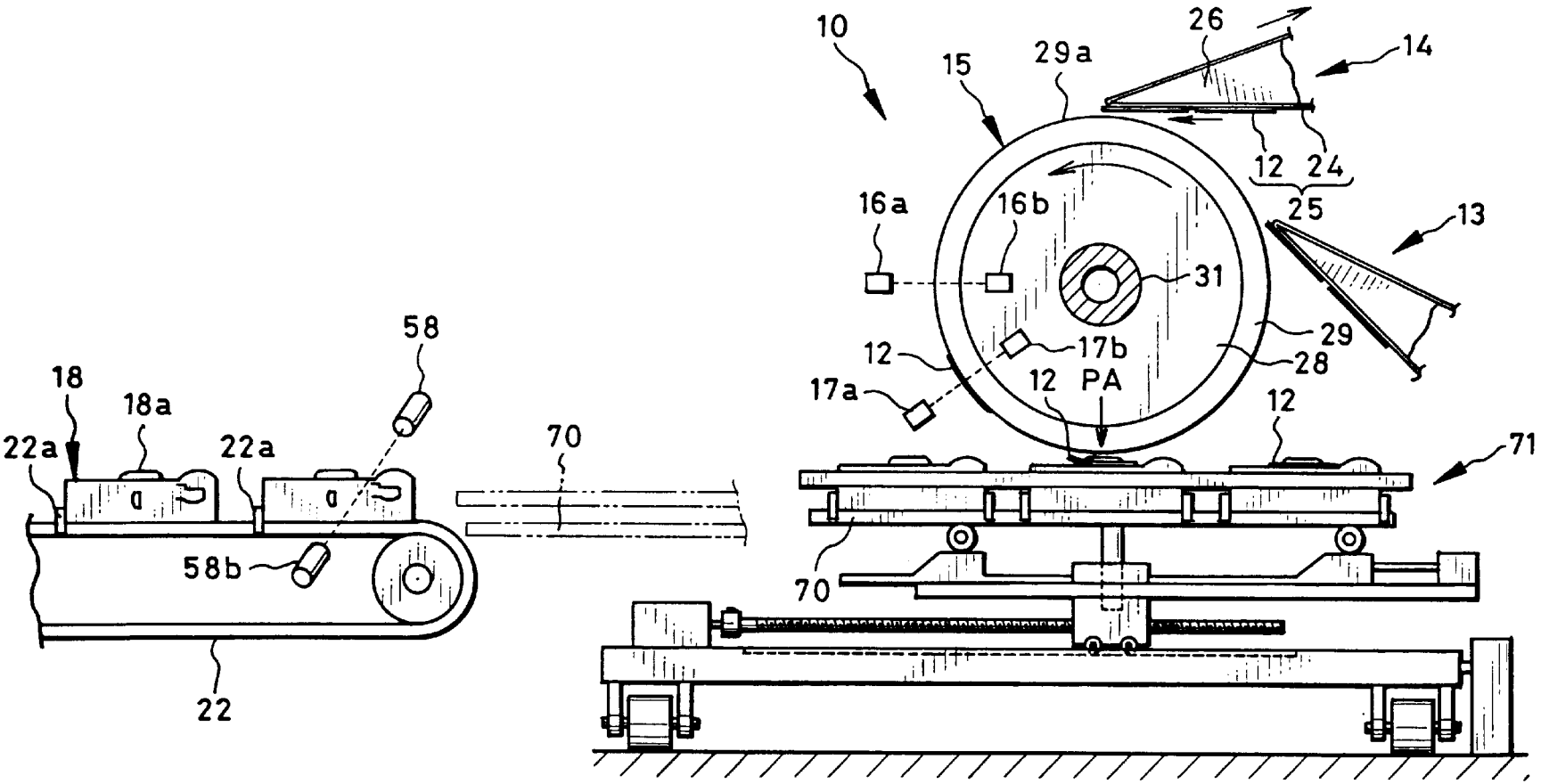
FIG. 9 is an explanatory side view of another label sticking apparatus.

FIG. 9 shows a workpiece moving device 71 which has a longer tray 70 and holds three film units 18. When the tray 70 is moved to a left side, the three film units 18 are set on the tray 70 by means of a robot hand. During each reciprocation of the tray 70, the label 12 is stuck on the three film units 18 in order.

In this embodiment, reference standby positions of the tray 70 relative to the X direction are set at three points corresponding to the three film units 18. Each of the reference standby positions is altered in accordance with the shifting of the label in the X direction. The tray 70 starts to move from the altered standby position. By the way, the reference standby position relative to the Y direction exists by one. Since the other structure and operation are similar to that shown in FIG. 1, a detailed description thereof is omitted.

In the above-described embodiments, for adjusting the X direction position, feed timing of the film unit is fixed and the standby position of the film unit relative to the X direction is adjusted. However, instead of this, the feed timing of the film unit may be adjusted. In this case, as shown in FIG. 6, when the label reference position S1 has reached a position PS1', the tray 35 is started to move from the reference standby position PX. This position PS1' is determined in accordance with the shifting amount X1 relative to the X direction.

Moreover, in the above embodiments, in order to alter the position of the film unit relative to the Y direction, the truck 47 is moved. However, the guides 55 may be moved in the Y direction. Further, two or more spare label suppliers may be provided. In this case, it is a matter of course that the supplying timing of each label supplier is adjusted so as not to overlap the label on the other label already absorbed on the suction drum.

Furthermore, the label 12 is supplied to the suction drum 15 such that the front edge 12*e* of the label 12 coincides with one of the label reference positions S1 to S4 on the suction drum 15. Instead of this, a specified position, the center of the label 12 or the rear edge of the label 12, for example, may be adjusted to the label reference positions S1 to S4.

Although a transmission-type sensor is used in the foregoing embodiments, a reflection-type sensor may be used. Further, instead of the above sensors, an image sensing device employing a CCD, for example, may be used. In this case, a more accurate position of the label is grasped so that it is possible to stick the label more accurately. Especially, it is preferable to use the image sensing device as the sensor for measuring the shifting of the label in the Y direction. The lens-fitted film unit is selected as a workpiece on which the label is stuck. However, the present invention is available to all fields of label sticking where label sticking accuracy is required.

Although the present invention has been fully described by way of the preferred embodiments thereof with reference to will be apparent to those having skill in this field. Therefore, unless otherwise these changes and modifications depart from the scope of the present invention, they should be construed as included therein.

What is claimed is:

1. A label sticking method for sticking a label on a workpiece, comprising the steps of:

forwarding said label from a first label supplier;

absorbing said forwarded label on a periphery of a suction drum rotating in a forwarding direction of said label;

conveying said label absorbed on said suction drum toward a label sticking station where sticking of said label is performed;

obtaining information on said label during conveyance thereof;

altering a standby position of said workpiece based on said information of said label, said standby position being altered prior to sticking of said label;

adjusting a position of said workpiece only in a direction of conveyance of said workpiece toward said label sticking station after said standby position is altered, and prior to sticking of said label, such that said label is accurately stuck on said workpiece; and feeding said workpiece to said label sticking station in synchronism with conveyance of said label in order to stick said label on said workpiece;

wherein a tray member for placing said workpiece thereon and a pair of guides for regulating a position of said workpiece placed on said tray member are provided, and said standby position of said workpiece is altered by moving said guides in a first direction and moving said tray member in a second direction.

2. A label sticking method according to claim 1, wherein said information on said label concerns a location relative to a width direction of said suction drum, and said standby position of said workpiece relative to said first direction which is identical with said width direction of said suction drum is altered based on said location of said label.

3. A label sticking method according to claim 2, wherein said information on said label further concerns a passage time at a point separating from said label sticking station by a predetermined interval, and said standby position of said workpiece relative to said second direction which is a tangential direction to said suction drum is altered based on said passage time.

4. A label sticking method according to claim 3, wherein a tray member for placing said workpiece thereon is provided, and said standby position of said workpiece is altered by moving said tray member in said first direction and said second direction.

5. The label sticking method according to claim 1, wherein adjustment of said position of said workpiece in said direction of conveyance of said workpiece is performed based on information detected by a sensor provided with said suction drum.

6. A label sticking method for sticking a label on a workpiece, comprising the steps of:

forwarding said label from a first label supplier;

absorbing said forwarded label on a periphery of a suction drum rotating in a forwarding direction of said label;

conveying said label absorbed on said suction drum toward a label sticking station where sticking of said label is performed;

obtaining information on said label during conveyance thereof;

altering a standby position of said workpiece based on said information of said label, said standby position being altered prior to sticking of said label;

adjusting a position of said workpiece only in a direction of conveyance of said workpiece toward said label sticking station after said standby position is altered, and prior to sticking of said label, such that said label is accurately stuck on said workpiece; and feeding said workpiece to said label sticking station in feed timing changed based on said information of said label in order to stick said label on said workpiece;

wherein a tray member for placing said workpiece thereon and a pair of guides for regulating a position of said workpiece placed on said tray member are provided, said standby position of said workpiece being altered by moving said guides in a width direction of said suction drum, and said feed timing of said workpiece being changed by varying said motion timing of said tray member to said label sticking station.

7. A label sticking method according to claim 6, wherein said information on said label concerns a location relative to said width direction of said suction drum and a passage time at a point separating from said label sticking station by a predetermined interval, said standby position of said workpiece relative to said width direction of said suction drum being altered based on said location of said label, and said feed timing of said workpiece being changed based on said passage time.

8. A label sticking method according to claim 7, wherein a tray member for placing said workpiece thereon is provided, said standby position of said workpiece being altered by moving said tray member in said width direction of said suction drum, and said feed timing of said workpiece being changed by varying motion timing of said tray member to said label sticking station.

9. A label sticking method according to claims 3 or 7, wherein said location of said label relative to said width direction of said suction drum is sensed by a location detecting sensor for detecting a side edge of said label, and said passage time of said label is sensed by a passage detecting sensor for detecting a front edge of said label.

10. A label sticking method according to claim 9, wherein said location detecting sensor and said passage detecting sensor are respectively a laser sensor including a beam emitter and a beam receiver.

11. A label sticking method according to claim 10, wherein a release paper on which said label is arranged is advanced along said label supplier, said label being torn off from said release paper at a tip of said label supplier and supplied to said suction drum.

12. A label sticking method according to claim 11, further comprising the step of:

detecting said workpiece conveyed by a conveyor belt toward said tray member, said workpiece being carried from said conveyor belt to said tray member based on detection of said workpiece.

13. A label sticking method according to claims 1 or 6, wherein said suction drum has a cylindrical shape.

14. A label sticking method according to claims 1 or 6, wherein said suction drum has a cross-like shape on its section.

15. A label sticking method according to claims 1 or 6, wherein a second label supplier for forwarding said label is provided, said label being supplied to said suction drum from one of both of said label suppliers concurrently, and from one of said label suppliers.

16. A label sticking method for sticking a label on a workpiece, comprising the steps of:

forwarding said label from a first label supplier;

absorbing said forwarded label on a periphery of a suction drum rotating in a forwarding direction of said label;

conveying said label absorbed on said suction drum toward a label sticking station where sticking of said label is performed;

obtaining information on said label during conveyance thereof;

altering a standby position of said workpiece based on said information of said label, said standby position being altered prior to sticking of said label;

adjusting a position of said workpiece only in a direction of conveyance of said workpiece toward said label sticking station after said standby position is altered, and prior to sticking of said label, such that said label is accurately stuck on said workpiece; and feeding said workpiece to said label sticking station in synchronism with conveyance of said label in order to stick said label on said workpiece;

wherein adjustment of said position of said workpiece is further performed in a direction perpendicular to said direction of conveyance of said workpiece by a workpiece moving device comprising a truck upon which said workpiece is supported, and a plurality of rollers provided at a lower portion of said truck, said rollers moving said workpiece in said direction perpendicular to said direction of conveyance of said workpiece.

17. A label sticking method for sticking a plurality of labels on a workpiece, comprising the steps of:

forwarding said labels respectively from a plurality of label suppliers;

absorbing said forwarded labels on a periphery of a suction drum rotating in a forwarding direction of said labels;

conveying said labels absorbed on said suction drum toward a label sticking station where sticking of said labels is performed;

obtaining information on said labels during conveyance thereof;

altering a standby position of said workpiece based on said information of said labels, said standby position being altered prior to sticking of said labels; and feeding said workpiece to said label sticking station in synchronism with conveyance of said labels in order to stick said labels on said workpiece;

wherein said labels are either one of the same and different from each other; and wherein a tray member for placing said workpiece thereon and a pair of guides for regulating a position of said workpiece placed on said tray member are provided, and said standby position of said workpiece is altered by moving said guides in a first direction and moving said tray member in a second direction.

18. A label sticking apparatus for sticking a label on a workpiece, comprising:

a first label supplier for forwarding said label;

a suction drum for absorbing said forwarded label, said suction drum rotating in a forwarding direction of said label and conveying said label to a label sticking station where sticking of said label is performed;

detecting means for detecting said label during conveyance thereof;

workpiece position altering means for altering a standby position of said workpiece based on information obtained by said detecting means, said standby position being altered prior to sticking of said label;

workpiece adjusting means for adjusting a position of said workpiece only in a direction of conveyance of said workpiece toward said label sticking station after said standby position is altered, and prior to sticking of said label, such that said label is accurately stuck on said workpiece; and workpiece feeding means for feeding said workpiece standing by at said altered standby position to said label sticking station in synchronism with conveyance of said label;

wherein said work position altering means includes a tray member for placing said workpiece thereon and a pair of guides for regulating a position of said workpiece placed on said tray member said standby position of said workpiece being altered by moving said guides in a first direction and moving said tray member in a second direction.

19. A label sticking apparatus according to claim 17, wherein said detecting means includes a location detecting sensor for sensing a location of said label relative to a width direction of said suction drum, and based on information obtained by said location detecting sensor, said workpiece position altering means alters said standby position of said workpiece relative to said first direction which is identical with said width direction of said suction drum.

20. A label sticking apparatus according to claim 19, wherein said detecting means further includes a passage detecting a sensor for detecting passage time of said label at a point separating from said label sticking station by a predetermined interval, and based on information obtained by said passage detecting sensor, said workpiece position altering means alters said standby position of said workpiece relative to said second direction which is a tangential direction to said suction drum.

21. A label sticking apparatus according to claim 20, wherein said workpiece position altering means includes a tray member for placing said workpiece thereon, said standby position of said workpiece being altered by moving said tray member in said first direction and said second direction.

22. A label sticking apparatus according to claims 21, wherein said workpiece feeding means moves said tray member to said workpiece sticking station.

23. The label sticking apparatus according to claim 18, wherein adjustment of said position of said workpiece in said direction of conveyance of said workpiece is performed based on information detected by a sensor provided with said suction drum.

24. The label sticking apparatus according to claim 18, wherein said workpiece adjusting means comprises:

a support member for supporting said workpiece;

a feed screw attached to said support member; and a motor for driving said feed screw to move the support member in said direction of conveyance of the workpiece.

25. A label sticking apparatus for sticking a label on a workpiece, comprising:

a first label supplier for forwarding said label;

a suction drum for absorbing said forwarded label, said suction drum rotating in a forwarding direction of said label and conveying said label to a label sticking station where sticking of said label is performed;

detecting means for detecting said label during conveyance thereof;

workpiece position altering means for altering a standby position of said workpiece based on information obtained by said detecting means, said standby position being altered prior to sticking of said label; and workpiece feeding means for feeding said workpiece standing by at said altered standby position to said label sticking station in feed timing changed based on said information obtained by said detecting means;

wherein said work position altering means includes a tray member for placing said workpiece thereon, and a pair of guides for regulating a position of said workpiece placed on said tray member, said standby position of said workpiece being altered by moving said guides in a width direction of said suction drum.

26. A label sticking apparatus according to claim 25, wherein said detecting means includes a location detecting sensor and a passage detecting sensor, said location detecting sensor sensing a location of said label relative to said width direction of said suction drum, and said passage detecting sensor sensing a passage time of said label at a point separating from said label sticking station by a predetermined interval.

27. A label sticking apparatus according to claim 26, wherein said workpiece position altering means alters said standby position relative to said width direction of said suction drum based on information obtained by said location detecting sensor, and said workpiece feeding means feeds said workpiece to said label sticking station in said feed timing changed based on information obtained by said passage detecting sensor.

28. A label sticking apparatus according to claim 27, wherein said workpiece position altering means includes a tray member for placing said workpiece thereon, said standby position of said workpiece being altered by moving said tray member in said width direction of said suction drum.

29. A label sticking apparatus according to claim 28, wherein said workpiece feeding means moves said tray member to said workpiece sticking station.

30. A label sticking apparatus according to claims 20 or 26, wherein said location detecting sensor senses said location of said label relative to said width direction of said suction drum by detecting a side edge of said label, and said passage detecting sensor senses said passage time of said label by detecting a front edge of said label.

31. A label sticking apparatus according to claim 30, wherein said location detecting sensor and said passage detecting sensor are respectively a laser sensor including a beam emitter and a beam receiver.

32. A label sticking apparatus according to claim 31, further comprising:

a release paper for arranging said label thereon, said label being advanced together with said release paper along said label supplier, and torn off from said release paper at a tip of said label supplier to be supplied to said suction drum.

33. A label sticking apparatus according to claim 32, further comprising:

a workpiece sensor for detecting said workpiece conveyed by a conveyor belt toward said tray member, said work being carried from said conveyor belt to said tray member based on a signal from said work sensor.

34. A label sticking apparatus according to claims 18 or 25, wherein said suction drum has a cylindrical shape.

35. A label sticking apparatus according to claims 18 or 25, wherein said suction drum has a cross-like shape on its section.

36. A label sticking apparatus according to claims 18 or 25, further comprising:

a second label supplier for forwarding said label, said label being supplied to said suction drum from one of both of said label suppliers concurrently, and from one of said label suppliers.

37. A label sticking apparatus for sticking a label on a workpiece, comprising:

a first label supplier for forwarding said label;

a suction drum for absorbing said forwarded label said suction drum rotating in a forwarding direction of said label and conveying said label to a label sticking station where sticking of said label is performed;

detecting means for detecting said label during conveyance thereof;

workpiece position altering means for altering a standby position of said workpiece based on information obtained by said detecting means, said standby position being altered prior to sticking of said label;

workpiece adjusting means for adjusting a position of said workpiece only in a direction of conveyance of said workpiece toward said label sticking station after said standby position is altered, and prior to sticking of said label, such that said label is accurately stuck on said workpiece; and workpiece feeding means for feeding said workpiece standing by at said altered standby position to said label sticking station in synchronism with conveyance of said label;

wherein adjustment of said position of said workpiece is further performed in a direction perpendicular to said direction of conveyance of said workpiece by a workpiece moving device comprising a truck upon which said workpiece is supported, and a plurality of rollers provided at a lower portion of said truck, said rollers moving said workpiece in said direction perpendicular to said direction of conveyance of said workpiece.

38. A label sticking apparatus for sticking a plurality of labels on a workpiece, comprising:

a first label supplier for forwarding said labels;

a suction drum for absorbing said forwarded labels, said suction drum rotating in a forwarding direction of said labels and conveying said labels to a label sticking station where sticking of said labels is performed;

detecting means for detecting said labels during conveyance thereof;

workpiece position altering means for altering a standby position of said workpiece based on information obtained by said detecting means, said standby position being altered prior to sticking of said labels; and workpiece feeding means for feeding said workpiece standing by at said altered standby position to said label sticking station in synchronism with conveyance of said labels;

wherein said labels are either one of the same and different from each other;

wherein said work position altering means includes a tray member for placing said workpiece thereon and a pair of guides for regulating a position of said workpiece placed on said tray member said standby position of said workpiece is altered by moving said guides in a first direction and moving said tray member in a second direction.

* * * * *